US005951500A

United States Patent [19]

Cutler

[11] Patent Number: 5,951,500

[45] Date of Patent: Sep. 14, 1999

[54] AUDIO RESPONSIVE MASSAGE SYSTEM

[75] Inventor: Stanley Cutler, Van Nuys, Calif.

[73] Assignee: JB Research, Inc., Bellflower, Calif.

[21] Appl. No.: 08/779,860

[22] Filed: Jan. 3, 1997

[51] Int. Cl.[6] ..... A61H 1/00

[52] U.S. Cl. ..... 601/47; 601/46-48; 601/56; 601/57; 601/60; 601/70

[58] Field of Search ..... 601/46–48, 56, 601/57, 60, 70

[56] References Cited

U.S. PATENT DOCUMENTS

| | | | |
|---|---|---|---|
| 2,821,191 | 1/1958 | Paii | 601/48 X |
| 4,750,208 | 6/1988 | Yamada et al. | 601/57 X |
| 4,779,615 | 10/1988 | Frazier | 601/47 |
| 5,076,260 | 12/1991 | Komatsu | 601/47 X |

FOREIGN PATENT DOCUMENTS

| | | | |
|---|---|---|---|
| 3237427 | 4/1984 | Germany | 601/47 |
| 3526725 | 1/1987 | Germany | 601/46 |
| 406269484 | 9/1994 | Japan | 601/47 |

*Primary Examiner*—Danton D. DeMille
*Attorney, Agent, or Firm*—Sheldon & Mak

[57] ABSTRACT

An audio-responsive massage system includes a pad for contacting a user of the system; a plurality of vibratory transducers, each transducer having an eccentric element for vibrating the pad at variable intensity and associated vibration frequency in response to a power signal; a microphone for response to a remotely located source to provide an audio signal; an audio filter for selecting a desired frequency characteristic of the audio signal; a detector circuit for producing a control signal as an amplitude envelope of the audio signal and including a detector diode connected for feeding a low-pass filter; a power amplifier for producing the power signal in response to a control signal; and a sequencer for periodically activating different ones of the transducers for drive by the power amplifier. Also disclosed is a method for massaging a user in response to an audio source including the steps of providing a massaging pad having a vibratory transducer coupled thereto, and a coupler connected to the transducer for variably powering the transducer; contacting the user with the pad; operating an envelope detector in response to the audio source for producing a control signal; and feeding the control signal to the coupler for activating the transducer, thereby massaging the user with variable intensity in response to the amplitude envelope of the audio source.

13 Claims, 5 Drawing Sheets

Fig. 1.
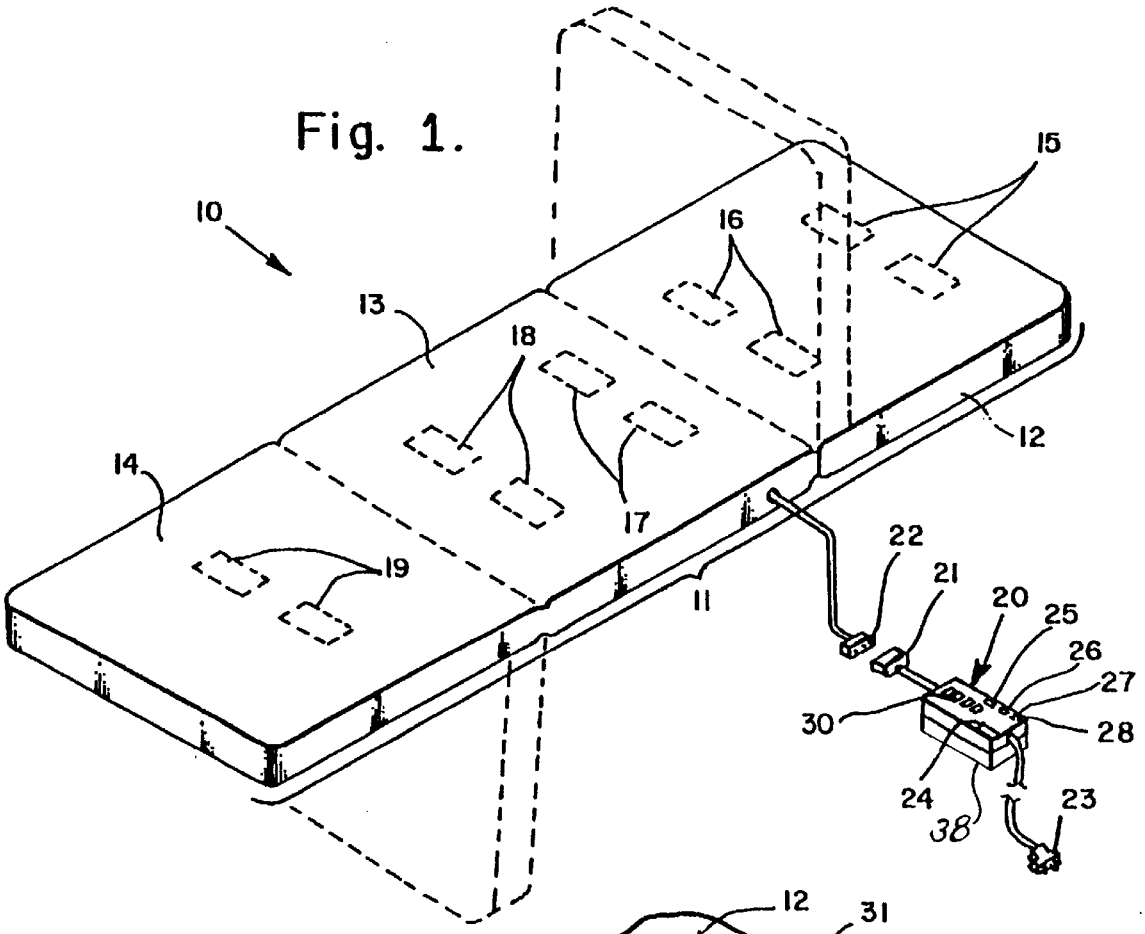
Fig. 2.
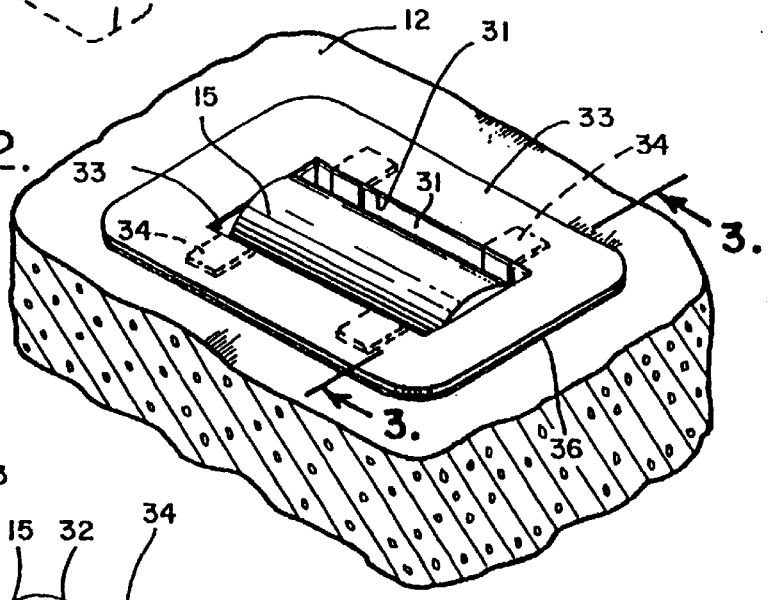
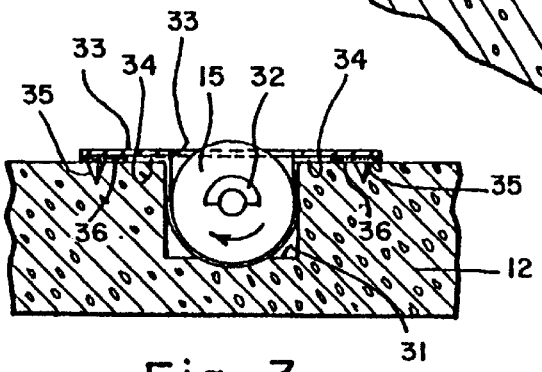
Fig. 3.

AUDIO RESPONSIVE MASSAGE SYSTEM

BACKGROUND

The present invention relates to massaging apparatus such as incorporating oscillatory transducers in cushioned members, and more particularly to such apparatus as interfaced to an audio source for response thereto.

Massage devices that are responsive to audio signals include those that have a loudspeaker that directly projects a sound signal onto a massage surface (U.S. Pat. No. 5,097,821 to Eakin), or a loudspeaker projecting a signal into a body of water (U.S. Pat. No. 3,585,991 to Balamuth). Other such devices include those having a vibrating element that is attached to a structural member (U.S. Pat. No. 3,556,088 to Leonardi), or wherein sound generates specific movement in an element that operates in cooperation with other elements (U.S. Pat. No. 5,446,934 to Frazier).

The audio-responsive massagers of the prior art have not been entirely satisfactory for at least some of the following reasons:

1. They are ineffective in that the massaging motion is not always at a suitable frequency; and 2. They are excessively complex and/or expensive to provide.

Thus there is a need for an audio responsive massage system that overcomes the disadvantages of the prior art.

SUMMARY

The present invention meets this need by providing an audio-responsive massage system. In one aspect of the invention, the system includes a pad for contacting a user of the system; a vibratory transducer having an eccentric element for vibrating the pad at variable intensity in response to a power signal; means for connecting an audio source to provide an audio signal; a detector circuit for producing a control signal as an amplitude envelope of the audio signal; and a coupler for producing the power signal in response to a control signal.

The detector circuit can include a detector diode connected for feeding an integrating filter. Preferably the system further includes an audio filter for selecting a desired frequency response to the audio signal. The coupler can be a power amplifier that can include a pass transistor or alternatively, a pulse-width modulator.

Preferably the means for connecting an audio source includes a microphone for response to a remotely located sound source. Also, or alternatively, the means for connecting an audio source includes a matching transformer for connection to an external sound circuit. The vibratory transducer can be one of a plurality of transducers, the system further including a sequencer for periodically activating different ones of the transducers for drive by the coupler.

In another aspect of the invention, a method for massaging a user in response to an audio source includes the steps of:

(a) providing a massaging pad having a vibratory transducer coupled thereto, and a coupler connected to the transducer for variably powering the transducer;

(b) contacting the user with the pad;

(c) operating an envelope detector in response to the audio source for producing a control signal; and (d) feeding the control signal to the coupler for activating the transducer, thereby massaging the user with variable intensity in response to the amplitude envelope of the audio source.

DRAWINGS

These and other features, aspects, and advantages of the present invention will become better understood with reference to the following description, appended claims, and accompanying drawings, where:

FIG. 1 is a diagrammatic perspective view of an audio-responsive massage system according to the present invention;

FIG. 2 is a detail perspective view of a vibration generator of the massage system of FIG. 1;

FIG. 3 is a sectional view on line 3—3 of FIG. 2;

DESCRIPTION

Figure 4:
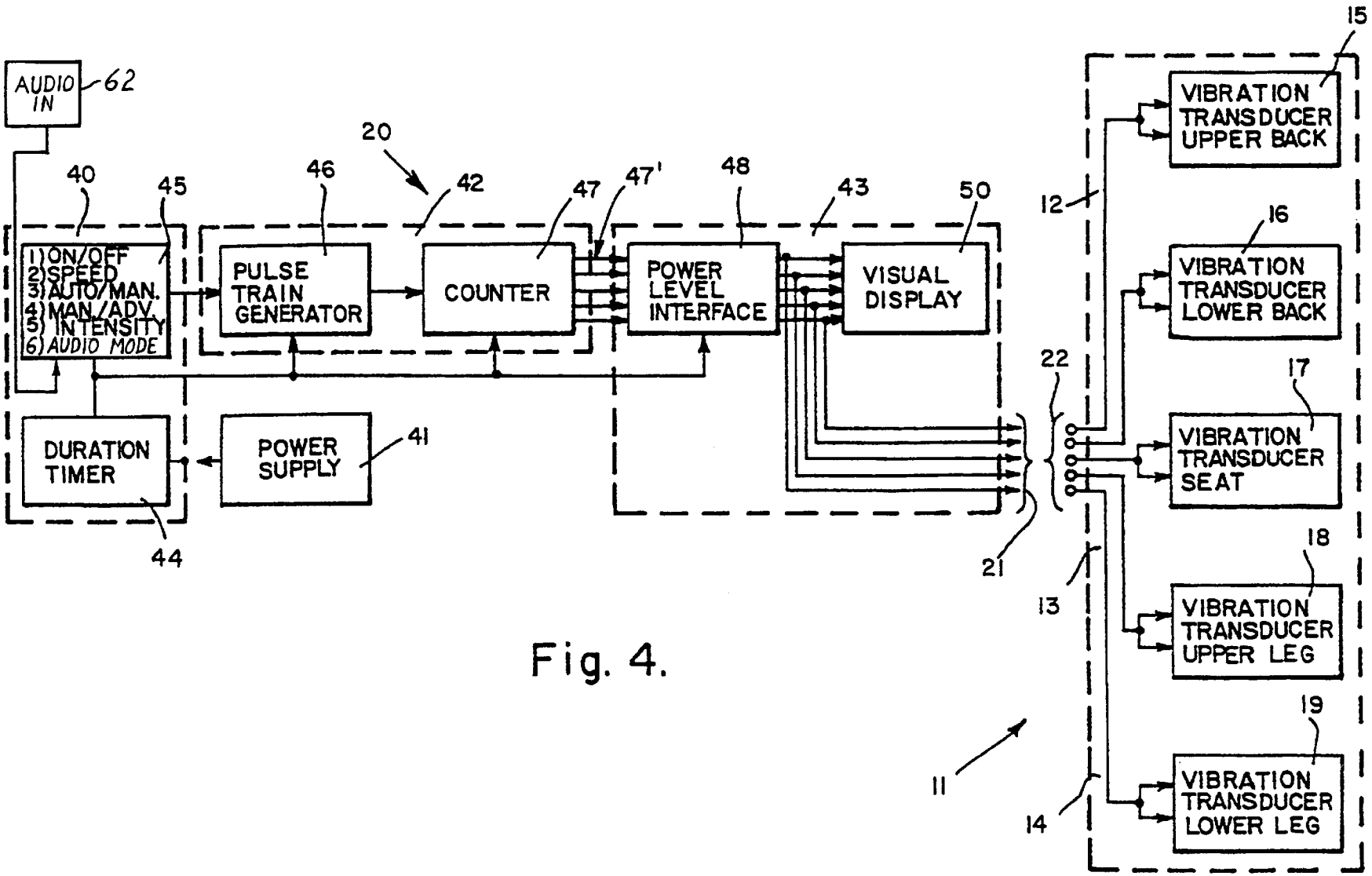
FIG. 4 is a block diagram of a control circuit of the massage system of FIG. 1.

The present invention is directed to a vibratory massage system that is responsive to an audio source. With reference to FIGS. 1–6 of the drawings, a massage system 10 includes a foldable pad 11 having a back portion 12, a seat portion 13, and a lower leg portion 14. An array of vibratory transducers are carried on the pad, including pairs of upper back transducers 15, lower back transducers 16, seat transducers 17, upper leg transducers 18, and lower leg transducers 19. As used herein, the designation 15 can also refer to any of the transducers 15, 16, 17, 18, or 19. A controller 20 is coupled to the transducers 16 by a plug 21 and socket 22, and having a conventional power plug 23. The vibratory transducers 15 are implemented as motors having eccentric weights 32, each motor being mounted to a plate 33 for support in a receptacle 31 by a pair of straps 34 that carry spikes 35, the straps being bonded to the pad 11 by an adhesive 36 as shown in FIGS. 2 and 3. It will be understood that the specific mounting of the transducers 15 is not within the scope of the present invention, and that variations are contemplated. One such variation is substitution of a single U-shaped member for the straps 34, tabs of the U-shaped member engaging slots in the plate 33 for securing the transducer 15 thereto, and the adhesive 36 bonding the plate 33 to cover the receptacle 31. Another variation is that the transducers 15 can be fastened directly to spring members of the pad 11.

Figure 5:
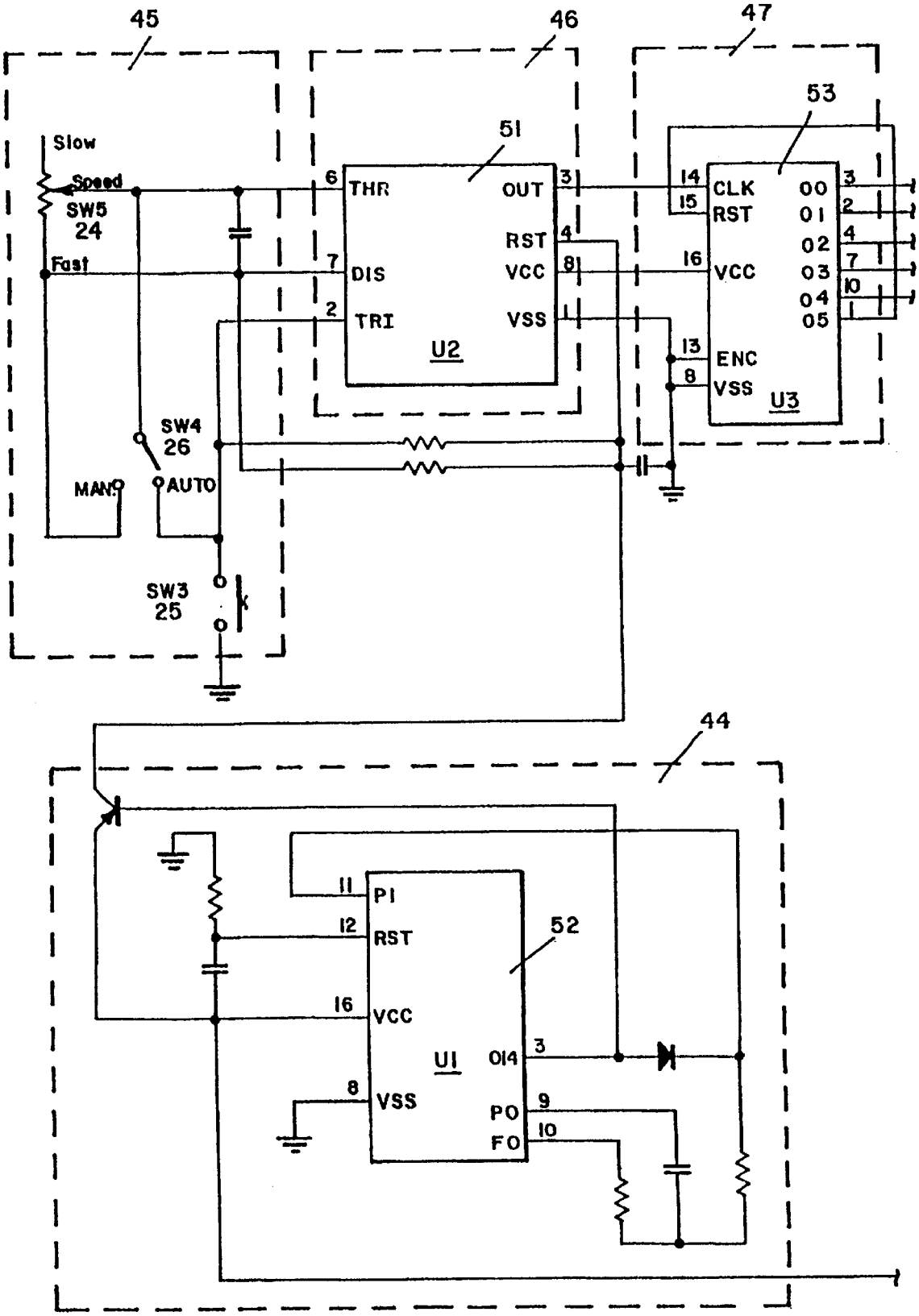
FIGS. 5 and 5A are together a schematic diagram of the control circuit of FIG. 4.
Figure 5A:
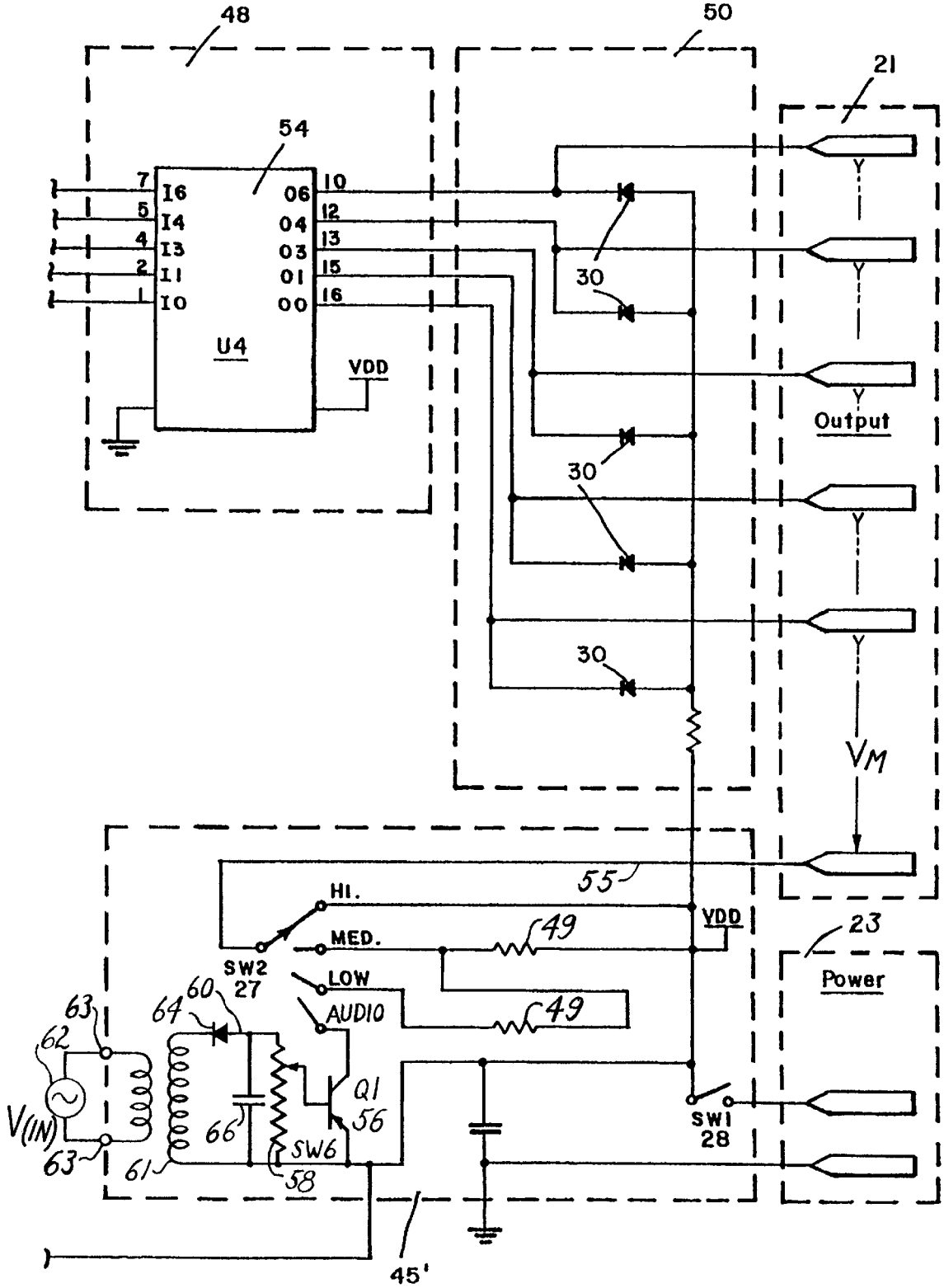
Figure 6:
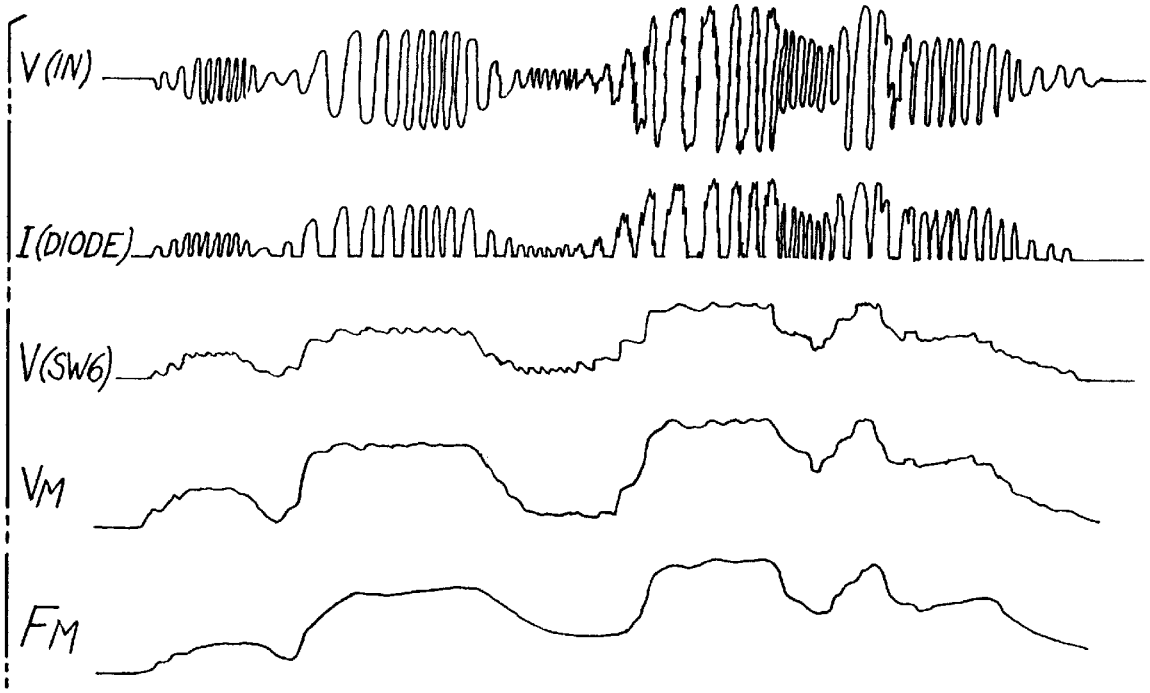
FIG. 6 is a waveform diagram of the massage system of FIG. 1.

A counterpart of the system 10 as so far been described above is more fully disclosed in U.S. Pat. No. 5,437,608 that issued to this inventor, the patent being incorporated fully herein by this reference. In that disclosure, the controller 20 has switch means 40 including a slider control 24, a push-button 25, and an auto/manual switch 26 in a switch array 45; and an intensity selection switch 27 and an on/off switch 28 in a switch array 45'. The controller 20, which can be powered from a power supply 41, has a pulse generator 42 including a pulse train generator 46 having a multivibrator 51, and a counter 47 having a counter chip 53; interface means 43 including a power level interface 48 having a power chip 54 that receives counter outputs 47'; a duration timer 44 having a timer chip 52; and a visual display 50 including lights 30. Dropping resistors 49 are connected to the selector switch 27 for operating the motor vibrators 15 at low, medium, and high massaging intensity as shown in FIG. 5A.

The massage system 10 of the present invention further includes means for feeding an audio signal to the controller 20, and circuity for modulating the massaging in correspondence with amplitude variations of the audio signal. More particularly, the controller 20 has an audio module 38 attached thereto as shown in FIG. 1 for supplying the audio signal. It will be understood that various forms of the audio module 38 are contemplated, such as a radio receiver, a tape player, and a music synthesizer, whether detachable, remote, of forming an integral part of the controller 20. As further shown in FIG. 5A, the intensity selector switch 27 is a four-position device, having an "audio" position in addition to the "high", "medium", and "low" positions as disclosed in the above-referenced '608 patent. In the "audio" position, the selector switch 27 drives a common power connection 55 of the vibrators 15 from a power pass transistor 56 (Q1), the base of the transistor 56 being connected to the wiper of a variable potentiometer 58 (SW6) that is part of an envelope detector circuit 60, the circuit 60 being fed by a matching transformer 61 from an audio source 62 through a pair of input terminals 63. For example, the audio source 62 can be a loudspeaker amplifier on which music is being played in the audio module 38. In the exemplary implementation of FIG. 5A, the detector circuit 60 includes a detector diode 64 and an integrating filter capacitor 66 that operates in conjunction with the potentiometer 58 (which also serves as an average intensity control) to drive the transistor 56 according to an amplitude envelope profile of the audio source 62, the transistor 56 serving as a power amplifier of the output of the detector circuit 60. It will be understood that the transistor 56 would not be required in case of the audio source 62 and the detector circuit 60 having sufficient power handling capacity to drive the vibrators 15 directly.

A important advantage of the present invention is that the amplitude of the vibrations are controlled in response to the amplitude of the audio signal, the vibrators 15 being operated at frequencies that are effective for massaging the user without regard to the audio frequency, thereby accentuating perceived responses to audio amplitude variations of the audio source 62. In the exemplary embodiment described above, and as shown in FIG. 6, a massage frequency $F_M$ varies in general correspondence with a voltage $V_M$ that is applied across one or more of the motor transducers 15. The voltage $V_M$ is produced by the transistor Q1 in response to an output voltage $V_{(SW6)}$ of the potentiometer SW6, being a smoothed (filtered) counterpart of a current $I_{(DIODE)}$, which corresponds to an amplitude envelope of the audio source 62. The frequency range of operation is independent of the frequency of the audio source, being dictated by operational characteristics of the motor vibrators 15, and by the voltage capabilities of the power supply 41 and the power level interface 48. Thus the massage system 10 of the present invention provides a particularly effective and low-cost audio response capability, by directly modulating vibratory frequency and power in response to audio amplitude. It is also contemplated, within the scope of the present invention, that the intensity of vibration can be controlled independently of the frequency of vibration, which can be fixed or variable. For example, the motor vibrators 15 can be operated at a fixed speed such as 3600 RPM to produce vibrations at 60 Hz, and the eccentricity of the eccentric weights 32 can be controllably varied in response to the detector circuit 60, such as by axially displacing a cam within the vibrators 15.

Figure 7:
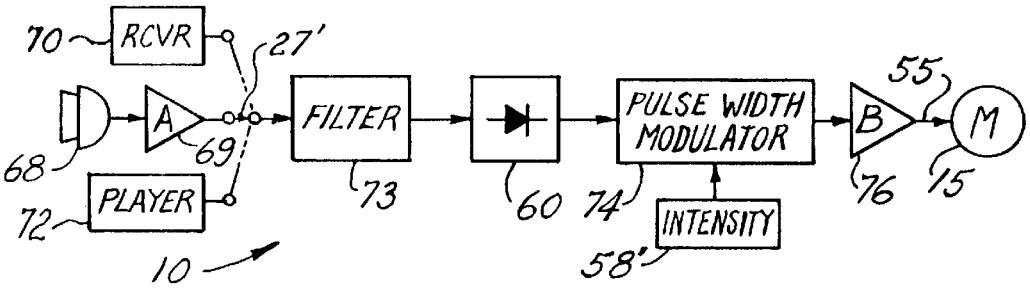
FIG. 7 is a block diagram showing an alternative configuration of the massage system of FIG. 1.

With further reference to FIG. 7, an alternative configuration of the massage system 10 has a counterpart of the selector switch, designated 27', connected for selecting one of a plurality of audio sources, including a microphone 68 that feeds a pre-amplifier 69, a radio receiver 70, and a player 72. It will be understood that one or more of the microphone 68, the receiver 70 and the player 72 can be contained in the audio module 38. The selector switch 27' feeds an audio filter 73 for providing a desired roll-off or low-pass characteristic for emphasizing a bass or rhythm music background, or high-pass characteristic for emphasizing treble portions of the music. The filter 73 feeds a counterpart of the detector circuit 60, and a pulse-width modulator circuit 74 and a power buffer 76 operate in place of the transistor 56 to drive one or more of the motor vibrators 15 through the common power connection 55, for avoiding unwanted heating and power loss associated with the transistor 56 and the dropping resistors 49 that are connected to the selector switch 27 of FIG. 5A. A counterpart of the potentiometer, designated 58', is connected to the pulse-width modulator 74 as an average intensity control. Other controls (not shown) can be provided with the filter 73 in a conventional manner for adjusting a desired audio response characteristic.

The massage system 10 of the present invention, in addition to providing enhanced massaging in response to the dynamic amplitude of music, is also effective in response to other sound sources, such as the audio output of video games and virtual reality presentations. The sounds can include those of racing cars, gunshots, and other phenomena, the perception of which is enhanced by correlated massaging intensity from the system 10.

Although the present invention has been described in considerable detail with reference to certain preferred versions thereof, other versions are possible. For example, the microphone 68 can be remotely connected through a radio or infrared wireless channel, and the preamplifier 69 can have an audio level set control and/or automatic gain control. Also, the pulse width modulator 74 can be implemented by discrete circuitry or by a programmed microprocessor. Therefore, the spirit and scope of the appended claims should not necessarily be limited to the description of the preferred versions contained herein.

What is claimed is:

1. A method for massaging a user in response to an audio source, comprising the steps of:

(a) providing a massaging pad having a vibratory transducer coupled thereto, and a coupler connected to the transducer at variable vibration frequency for powering the transducer;

(b) contacting the user with the pad;

(c) operating a rectifying envelope detector in response to the audio source for producing a control signal; and (d) feeding the control signal to the coupler for activating the transducer, thereby massaging the user with variable intensity in response to the amplitude envelope of the audio source.

2. The method of claim 1, wherein the vibratory transducer comprises a motor having an eccentric weight, the coupler being connected for driving the motor, the step of feeding the coupler thereby varying a massage frequency of the vibratory transducer in correspondence with the amplitude envelope.

3. An audio-responsive massage system comprising:

(a) a pad for contacting a user of the system;

(b) a vibratory transducer having an eccentric element for vibrating the pad at a massage frequency, with vibrations being at variable intensity in response to a variable power signal;

(c) means for connecting an audio source to provide an audio signal;

(d) a rectifying detector circuit for producing a control signal as an amplitude envelope of the audio signal; and (e) a coupler for producing the power signal in response to the control signal.

4. The massage system of claim 3, wherein the detector circuit comprises a detector diode connected for feeding an integrating filter.

5. The massage system of claim 3, further comprising an audio filter for selecting a desired frequency response to the audio signal.

6. The massage system of claim 3, wherein the coupler comprises a power amplifier.

7. The massage system of claim 6, wherein the power amplifier comprises a pass transistor.

8. The massage system of claim 6, wherein the power amplifier comprises a pulse-width modulator.

9. The massage system of claim 3, wherein the means for connecting an audio source comprises a microphone for response to a remotely located sound source.

10. The massage system of claim 3, wherein the means for connecting an audio source comprises a matching transformer for connection to an external sound circuit.

11. The massage system of claim 3, wherein the vibratory transducer is one of a plurality of transducers, the system further comprising a sequencer for periodically activating different ones of the transducers for drive by the coupler.

12. The massage system of claim 3, wherein the eccentric element is coupled to a motor, the motor being driven by the variable power signal, whereby the massage frequency varies in corresponds to the variable intensity.

13. An audio-responsive massage system comprising:

(a) a pad for contacting a user of the system;

(b) a plurality of vibratory transducers, each vibratory transducer comprising a motor having an eccentric element, to vibrate the pad at variable intensity and associated vibration frequency in response to a variable power signal;

(c) an input connection for providing an audio signal;

(d) an audio filter for selecting a desired frequency characteristic of the audio signal;

(e) a rectifying detector circuit for producing a control signal as an amplitude envelope of the audio signal, the detector circuit comprising a detector diode connected for feeding an integrating filter;

(f) a power amplifier for producing the variable power signal in response to a control signal; and (g) a sequencer for periodically activating different motors of the transducers for drive by the power amplifier, activated ones of the motors.

* * * * *